United States Patent [19]

VanderLugt

[11] Patent Number: 4,648,536

[45] Date of Patent: Mar. 10, 1987

[54] CARTON FOR DISPENSING SHEET MATERIAL IN ROLL FORM

[75] Inventor: Thomas VanderLugt, Kalamazoo, Mich.

[73] Assignee: James River Corporation of Virginia, Norwalk, Conn.

[21] Appl. No.: 739,735

[22] Filed: May 31, 1985

[51] Int. Cl.[4] ..... B65D 85/671

[52] U.S. Cl. ..... 225/43; 225/48; 225/90

[58] Field of Search ..... 225/43, 48–50, 225/80, 90

[56] References Cited

U.S. PATENT DOCUMENTS

| | | | |
|---|---|---|---|
| Re. 19,134 | 4/1934 | Powell | 225/49 |
| 1,364,743 | 1/1921 | Fuerth | 225/52 |
| 1,938,269 | 12/1933 | Wilson | 225/48 |
| 3,137,424 | 6/1964 | Finn et al. | 225/48 |
| 3,181,034 | 10/1966 | Woodling | 225/48 |
| 3,549,066 | 12/1968 | Wankow | 225/25 |
| 3,552,614 | 1/1971 | Wilson | 225/20 |
| 3,974,947 | 8/1976 | Budny | 225/25 |
| 4,340,162 | 7/1982 | Heiman et al. | 225/48 |
| 4,474,318 | 10/1984 | Perrin | 225/90 |
| 4,534,497 | 8/1985 | Neale | 225/48 |

*Primary Examiner*—Frank T. Yost
*Assistant Examiner*—Hien H. Phan
*Attorney, Agent, or Firm*—William A. Aguele; Harry W. Hargis, III; Thomas H. Whaley

[57] ABSTRACT

Reclosable carton structure of a generally rectangular configuration is set up from a paperboard blank. A hooded cover is hingedly mounted over the open top of the carton and includes a serrated cutter bar extending along a free edge of the cover. A flap on the blank is folded to extend over and is adhered along its free edge to the inside of the carton wall underlying the portion of the hooded cover that includes the cutter bar. A tab is formed in the same carton wall by a knife cut main portion parallel to the fold of the flap and a pair of end portions each extending transversely of and from an end of the main portion, both end portions terminating between the fold and the adhered edge. Resilience of the paperboard, in combination with cooperative dispositions of the flap and the tab, causes the tab to be pivotally urged outwardly from the surface of the wall, pivotation occurring when the hooded cover is open. A roll of wrapping film in the carton has its free end extending over the pivoted tab which presents the film end for grasping and pulling to unroll a desired length for tearing against the serrated cutter bar. The center of the tab defining knife cut is upwardly arched to provide a finger notch facilitating grasping of the film, and a tack material on the tab aids in holding the free end of the film from retracting into the carton.

5 Claims, 8 Drawing Figures

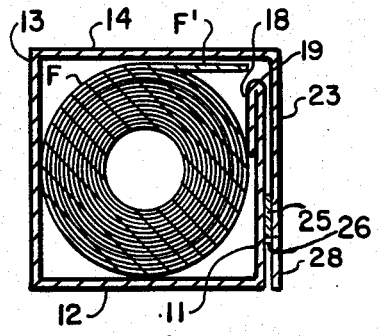
FIG.4
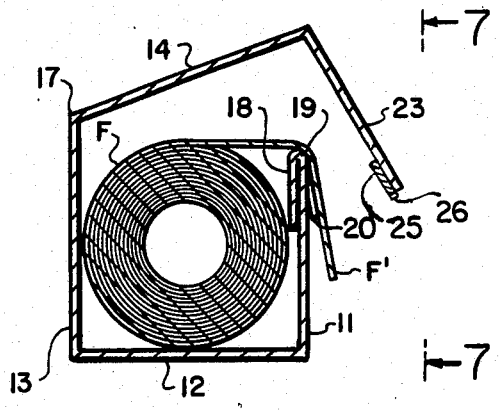
FIG.6
FIG.5
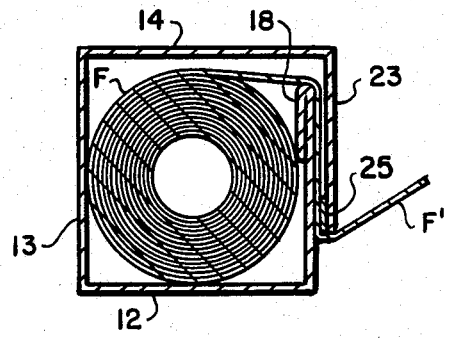
FIG.7
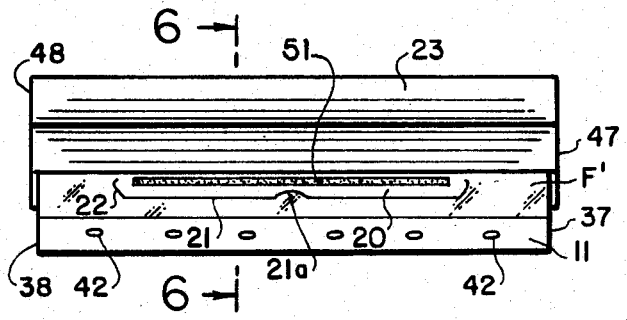
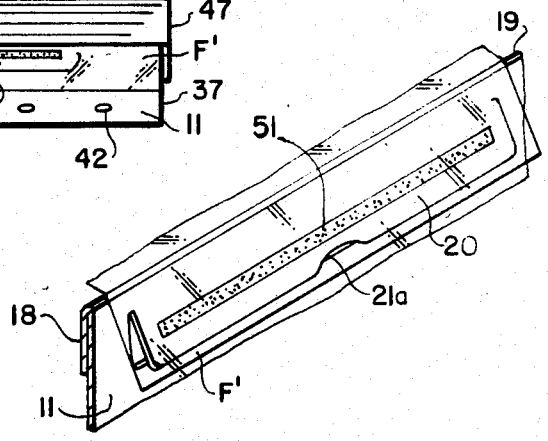
FIG.8

CARTON FOR DISPENSING SHEET MATERIAL IN ROLL FORM

BACKGROUND OF THE INVENTION

This invention relates to packaging, and more particularly to improvements in paperboard carton structure of the type used for dispensing sheet material in roll form.

Sheet material such as polymeric film used for wrapping has found wide usage, and a characteristic of one well known film of this type is that it sticks to itself or to smooth surfaces. This characteristic has its advantages in that it affords a self sealing overwrap for foods themselves or for containers in which foods are stored. The sticking characteristic, however, renders the film often difficult to dispense. For example, polymeric film of this type is provided in roll form in paperboard cartons of comparable dimensions to the roll. Typically, a carton has a hooded, pivotal lid provided with a serrated cutter bar that extends along the free edge of the lid. The free edge also normally includes a tear strip adherent to the front wall to seal the lid and protect the cutter bar during handling. Removal of the strip permits opening the carton and exposure of the cutter bar. The free end of the film is grasped while the lid is open, a desired length is unrolled by pulling the roll end, and the lid is closed to trap the film between the hood and the front of the carton. While thus held, the film is folded back over the cutter bar and pulled to tear it from the roll, leaving a new free end of the film disposed between the hood and the front of the carton.

It has been at this stage that there is a tendency of the film to retract into the carton, making it difficult for the subsequent user to grasp the free end of the film.

Efforts directed to overcoming these and other difficulties have taken a number of forms, examples of which are found in prior art (all U.S. Patents) as described in what follows:

U.S. Pat. No. 3,974,947 discloses a carton for dispensing polymeric film, wax paper, metal foil or the like from a roll including a front wall having an outer ply 46 and an inner ply 48 folded on line 50 and adhesively joined to the inner surface of the outer ply. An opening 54 in ply 46 exposes an adhesive material for retaining the film tail;

U.S. Pat. No. Re 19,134 discloses a carton for dispensing paper from a roll, including a hinged cover provided with a top flap 8 having a downturned front primary flap 10. A secondary flap 12 is hinged on the free edge of flap 10 and folded. The inherent resilience of flap 12 urges it against the front wall of the carton so that the free end of the paper is held between the flap and the wall;

U.S. Pat. No. 1,364,743 discloses a dispensing carton for waxed paper in roll form, including a finger opening 26 in cover 16 facilitating grasping of the free end of the paper to be dispensed;

U.S. Pat. No. 1,938,269 discloses a carton for dispensing waxed paper, or the like from a roll, including wall member 4 having a tab 16 cut therefrom capable of being manually resiliently biased into engagement with the free end of the paper while tearing, and upon release to accommodate self feeding of a small length of paper to facilitate grasping the free end for subsequent dispensing;

U.S. Pat. Nos. 3,137,424 and 3,549,066 disclose dispensing cartons for roll sheet material wherein a coating is provided on a portion of the carton to retain the free end of the material to be dispensed.

It is a general objective of this invention to provide an improved carton for facilitating the selective dispensing of predetermined lengths of sheet material from a roll within the carton.

It is a further, and more specific objective to provide an improved carton formed from a paperboard blank and facilitating dispensing of sheets of polymeric material therefrom.

In achievement of the foregoing as well as other objectives, the invention contemplates a paperboard carton formed from a suitably cut and scored blank, comprising:

rear, bottom, front, and side walls;

a hinged cover on said rear wall extending over the open top of said carton and including a downturned flap extending over said front wall;

a cutter bar on said downturned flap including a cutting edge substantially coextensive with the free edge thereof;

a flap on the upper edge of said front wall folded downwardly about said edge over the inside surface of said front wall and adhered thereto along a line of adherence substantially parallel to said upper edge and spaced therefrom; and a tab in said front wall defined by a knife cut including a main portion extending parallel to said upper wall edge and disposed between said upper wall edge and said line of adherence, of said flap to said inside surface of front wall, said knife cut further including a pair of portions each extending from an end of said main portion transversely of its line of extent and terminating in the region between said line of adherence and said upper edge, said tab being urged pivotally outwardly from said flap by the inherent resilience of the paperboard folded along said edge;

the construction and arrangement of said carton being such that the free end of a contained film roll disposed between said front wall and said flap is, upon hingedly opening said carton, urged away from said front wall by the recited resilient pivotation of said tab, thereby facilitating grasping thereof.

The manner in which the objectives of the invention may best be achieved will be more fully understood from a consideration of the following description, taken with reference to the accompanying drawings.

BRIEF DESCRIPTION OF THE DRAWINGS

FIG. 4 is a sectional view, in elevation, taken in the plane of line 4—4 indicated by arrows 4—4 in FIG. 3;

FIG. 5 is a sectional view similar to FIG. 4, wherein an operational feature of the invention is shown;

FIG. 6 is a sectional view of the carton seen in FIG. 5, and showing a further operational feature;

FIG. 7 is an elevational showing of the carton as seen looking in the direction of arrows 7—7 in FIG. 6; and FIG. 8 is a fragmented perspective showing of the carton in the mode seen in FIGS. 5 and 6.

Figure 1:
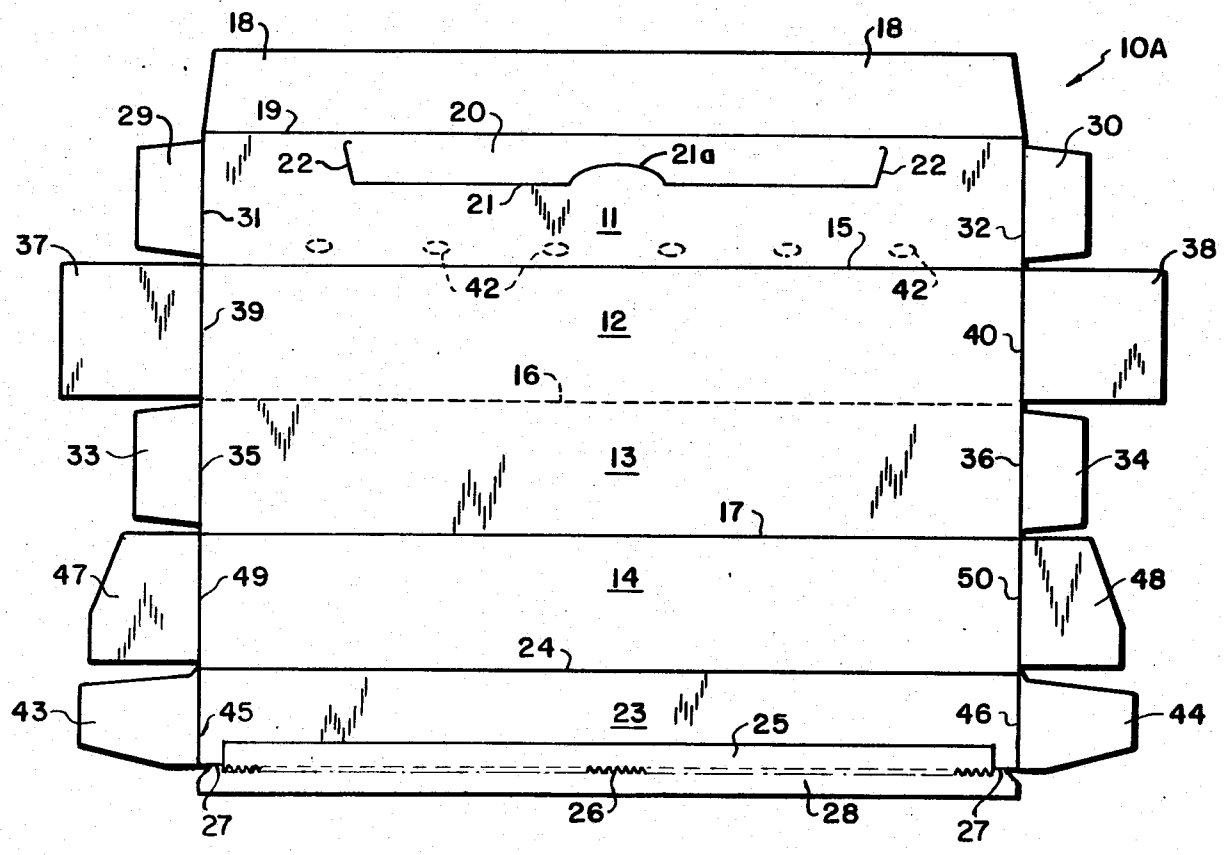
FIG. 1 is a top plan view of the inside surface of a paperboard blank from which the carton embodying the invention is set up.

With more detailed reference to the drawings, in FIG. 1 a suitably cut and scored paperboard blank 10A includes front, bottom, rear, and top walls 11, 12, 13, and 14, respectively. Adjacent ones of the walls are hingedly connected along respective parallel score lines 15, 16, and 17.

A reinforcing flap 18, the purpose of which is to be more fully described in what follows, is hingedly connected to front wall 11 along score line 19. A tab 20 in front wall 11 is defined by a knife cut through the wall that includes a main portion 21 parallel to score line 19 and disposed between score lines 19 and 11, and a pair of portions 22, each extending from the ends of main portion 21, transversely of its line of extent, and terminating between the main portion and score line 19. The main knife cut portion 21 includes an upwardly arched cut 21*a*.

In provision of a hinged cover, a hood flap 23 is hingedly joined to top wall 14 along a score line 24, and a cutter bar 25 is provided on flap 23 parallel to its free edge and score line 24. Cutter bar 25 includes a serrated cutting edge 26 substantially coextensive with a line of weakness 27 on hood flap 23, and which line 27 defines a tear strip 28 on one free edge portion of flap 23. A pair of glue flaps 43, 44 are joined to hood flap 23 by respective score lines 45 and 46, and a pair of end flaps 47, 48 are joined to wall panel 14 by respective score lines 49 and 50.

Blank 10A further includes: glue flaps 29 and 30 hingedly joined to front wall 11 along respective score lines 31 and 32; glue flaps 33 and 34 hingedly joined to rear wall 13 along respective score lines 35 and 36; end flaps 37 and 38 joined to bottom wall 12 along respective score lines 39 and 40; and generally oval surface cut scores 42 on the outer surface of front wall 11.

Figure 2:
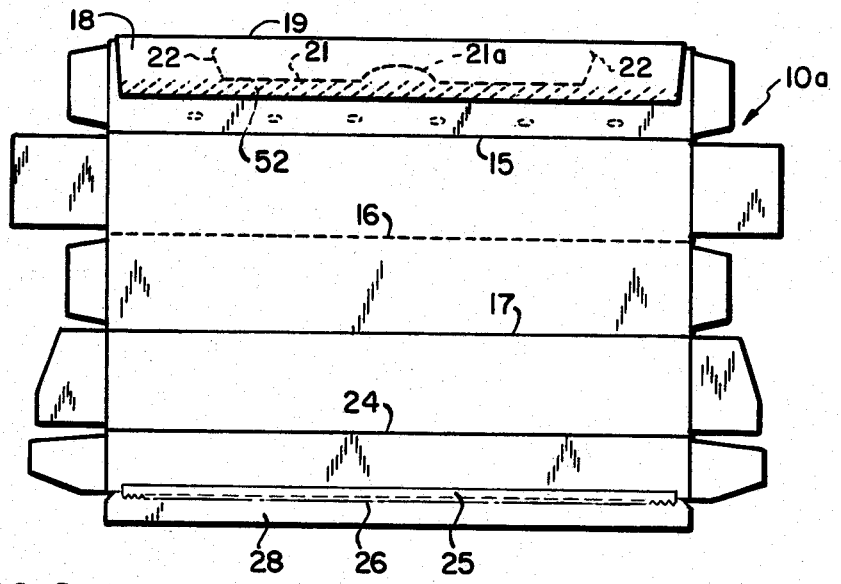
FIG. 2 is a view of the blank of FIG. 1, in a partially set-up mode.

With reference to FIG. 2, and for reasons to be more fully appreciated from what follows, flap 18 is folded downwardly about score line 19, i.e., the upper edge of front wall 11, to overlie the inside surface of front wall 11, and it is adhered to the front wall along a line of adherence region 52 thereof between knife cut 21 and score line 15, i.e., the bottom front edge of the carton.

Figure 3:
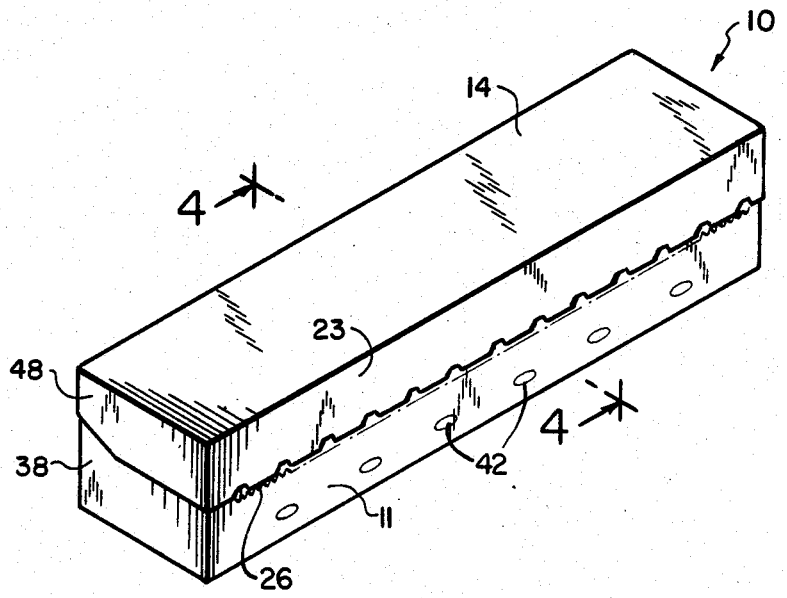
FIG. 3 is a perspective view of a carton set up from the blank seen in FIGS. 1 and 2, and with a roll of sheet material (not shown) contained therein.

With reference to FIG. 3, the partially set-up blank 10A of FIG. 2 has been further set up into carton 10, wherein front and rear walls 11 and 13, respectively, have been folded upwardly about the respective score lines 15 and 16. Also glue flaps 30 and 34 have been folded upwardly about respective score lines 32 and 36, and end flap 38 has been folded about score line 40 to overlie the glue flaps 30, 34 to which it is adhered. Similarly, glue flaps 29 and 33 have been folded about respective score lines 31 and 35, and end flap 37 has been folded about score line 39 and adhered to the glue flaps 29, 33.

Further to the set up carton 10, and with reference also to FIG. 4, a roll of film material F, for example any one of the well known polymeric materials, is contained within the carton with top wall 14 folded over the roll about score line 17. Flap 23 is folded downwardly over front wall 11, and tear strip 28 is adhdered in localized regions 41 defined by generally oval surface cut scores 42 (FIGS. 1, 2, & 7) on the outer surface of front wall 11. It will be of course understood that the tear-strip closure, while preferred, is not necessary to the invention. For example, the tear-strip closure may be eliminated, and a band or overwrap provided to maintain original sealing of the fully set-up carton.

In completion of the carton assembly, and in formation of the hooded cover, glue flaps 43 and 44 are folded rearwardly about respective score lines 45, 56; and end flaps 47 and 48 are folded about respective score lines 49, 50 and adhered to the respectively underlying glue flaps 43, 44. It also will be understood that the sequence of flap closures and sealings—both of the cover and the carton—will be conventional, as will dictated by the mode of loading the roll F into the carton while it is partially assembled.

In using the roll material, and with reference to FIG. 5, tear strip 28 is removed in a conventional manner by grasping one end and pulling it away from the carton, thereby releasing the hooded cover and exposing cutting edge 26. The cover is opened by pivotation about score line 17, the tail F′ of film F is grasped and pulled to present the desired length, the cover is closed as seen in FIG. 5, and the tail F′ is then folded back over the hood flap 23 and pulled against cutter bar 25 to tear it from the roll.

As is seen in FIGS. 6 and 7, the tail F′ will then remain extended over outwardly pivoted tab 20 and releasably adhered to tack material 51 of suitable makeup, any number of which materials are known in the art and applied in a predetermined pattern. In the present embodiment it is preferred to apply material 51 in a strip as shown. Suitable tack materials for roll films of polymeric materials, wax paper, metal foil, or the like, contemplated by the present invention are disclosed in the referenced U.S. Pat. No. 3,974,947, and its disclosure is incorporated herein.

In particular accordance with the present invention, and as is seen to advantage in FIGS. 6, 7, and 8, tab 20 will have been pivoted outwardly from the plane of front wall 11 under the urging of energy stored in the flexible and resilient paperboard where it has been bent or folded about score line 19 between flap 18 and tab 20, in the course of carton set-up. This outward pivotation of tab 20 advantageously presents the film tail F′ away from front wall 11, where it is easily grasped at the central arcuate cutout of the tab afforded by arcuate cut 21*a*. More specifically, outward pivotation of tab 20 has been found to be characterized by a slight outward bowing of the tab in which its central region is spaced from wall 11 further than the end regions, due in part to the reduced cross section afforded by acuate cut 21*a*, which cut also serves as a finger notch that aids in grasping the film.

Although knife cuts 21, 21*a*, and 22 have been illustrated as being continuous, it is to be understood that the invention contemplates that the cuts be discontinuous to some degree. In effect, forming these cuts as readily torn lines of weakness would have advantages in the carton set-up stages to insure that the blank remains planar through the machine operations, especially while stacking and feeding. In the course of carton set-up, and prior to sealing of the hood flap 23 to wall 11, force will have been applied to release tab 20 in the regions of the lines of weakness. Accordingly, the term "knife cut" contemplates either a continuous or a discontinuous cut (i.e., line of weakness).

While a preferred embodiment of the invention has been disclosed, it will be understood that it is susceptible of modifications, as is contemplated by the scope of the appended claims.

I claim:

1. A paperboard carton for dispensing sheet material from a roll of said material disposed within the carton, comprising:

at least a front planar wall including an edge over which a free end of said material extends;

a flap on said front wall folded along an upper edge, extending over an inner surface of said wall and adhered thereto along a line of adherence substantially parallel to said upper edge and spaced therefrom; and a tab in said front wall defined by a knife cut therethrough including a main portion extending substantially coextensive with said upper edge and disposed between said upper edge and said line of adherence, said knife cut further including a pair of portions each extending from an end of said main portion transversely of its line of extent and terminating in a region between the line of adherence and said upper edge of said wall, said tab being urged pivotally outward from said front wall by the inherent resilience of the flap folded along said upper edge, said tab being provided with a tack material on the surface adjacent the free end of said material effective to engage and hold the free end of said material and urge the free end of said material away from the front wall and present it for grasping by a user.

2. The carton of claim 1, including a hinged cover on said carton movable between opened and closed positions, having a downturned flap extending over said tab in the closed position of said cover, said means on said downturned flap defining a cutting edge substantially coextensive with said knife cut main portion of said front wall tab, whereby the edge of said free end of said material upon cutting is substantially coextensive with said front wall tab.

3. The carton of claim 2, wherein said front wall tab includes an inwardly arched section further facilitating grasping of said free end of said material.

4. A paperboard carton formed from a suitably cut and scored blank, comprising:

rear, bottom, front, and side wall panels cooperatively disposed to form a top opening defined by upper edges of said rear, front and side wall panels;

a hinged cover on said rear wall panel extending over the top opening of said carton, and including a downturned flap with a free edge extending over said front wall;

a cutter bar on said downturned flap including a cutting edge substantially coextensive with the free edge thereof; a flap on the upper edge of said front wall folded downwardly about the upper edge over an inside surface of said front wall and adhered thereto along a line of adherence substantially parallel to said upper edge and spaced therefrom; and a tab in said front wall defined by a knife cut therethrough including a main portion extending substantially parallel to said upper edge and disposed between said upper edge and said line of adherence, said knife cut further including a pair of portions each extending from an end of said main portion transversely of its line of extent and terminating in a region between said line of adherence and said upper edge, said tab being provided with a tack material on its outer surface and being urged pivotally outwardly from said front wall by the inherent resilience of the flap folded along said upper edge; and the construction and arrangement of said carton being such that the free end of a contained film roll disposed between said front wall and said downturned flap of said cover is held by said tack material and upon hingedly opening said carton is urged away from said front wall by the recited resilient pivotation of said tab, thereby facilitating grasping the end thereof by a user.

5. A carton according to claim 4, including a line of weakness on said downturned flap extending substantially parallel to the free edge of said downturned flap and defining a tear strip.

* * * * *